US012180622B2

(12) United States Patent
Song et al.

(10) Patent No.: US 12,180,622 B2
(45) Date of Patent: Dec. 31, 2024

(54) MULTIPLE WOVEN LENO-JACQUARD FABRIC AND SHOE UPPER MANUFACTURED THEREFROM

(71) Applicant: Soo Bok Song, Busan (KR)

(72) Inventors: Soo Bok Song, Busan (KR); Won Seok Song, Busan (KR); Ji Hyun Song, Busan (KR); Kapsoo Hwang, Busan (KR); Sinje Park, Busan (KR)

(73) Assignee: Soo Bok Song, Busan (KR)

( * ) Notice: Subject to any disclaimer, the term of this patent is extended or adjusted under 35 U.S.C. 154(b) by 0 days.

(21) Appl. No.: 18/288,156

(22) PCT Filed: Oct. 24, 2022

(86) PCT No.: PCT/KR2022/016214
§ 371 (c)(1),
(2) Date: Oct. 24, 2023

(87) PCT Pub. No.: WO2023/128184
PCT Pub. Date: Jul. 6, 2023

(65) Prior Publication Data

US 2024/0200240 A1 Jun. 20, 2024

(30) Foreign Application Priority Data

Dec. 31, 2021 (KR) ..... 10-2021-0194742

(51) Int. Cl.
*D03D 13/00* (2006.01)
*D03D 1/00* (2006.01)
(Continued)

(52) U.S. Cl.
CPC ..... *D03D 11/00* (2013.01); *D03D 1/00* (2013.01); *D03D 13/004* (2013.01); *D03D 15/56* (2021.01);
(Continued)

(58) Field of Classification Search
CPC ..... D03D 11/00; D03D 1/00; D03D 13/004; D03D 15/56; D03D 19/00; D03D 13/006;
(Continued)

(56) References Cited

U.S. PATENT DOCUMENTS 3,965,944 A * 6/1976 Goff, Jr. ..... D03D 15/56 139/421
7,750,200 B2 7/2010 Leuprecht
(Continued)

FOREIGN PATENT DOCUMENTS

JP 2006-0299442 A 11/2006
KR 2007-0089986 A 9/2007
(Continued)

OTHER PUBLICATIONS

International Search Report from corresponding PCT Application No. PCT/KR2022/016214, dated Aug. 7, 2023.

*Primary Examiner* — Robert H Muromoto, Jr.
(74) *Attorney, Agent, or Firm* — Harness, Dickey & Pierce, P.L.C.

(57) ABSTRACT

The present disclosure relates to a multiple woven fabric including a ground weave and a pattern weave, in which the ground weave and the pattern weave are arranged to be neighboring, the ground weave includes a plain weave woven so that a warp and a weft participate in weaving, and the pattern weave is a multi-layer weave including a first weave forming a first layer and a second weave separated from the first layer to form a second layer.

17 Claims, 12 Drawing Sheets

(51) Int. Cl.
*D03D 11/00* (2006.01)
*D03D 15/56* (2021.01)
*D03D 19/00* (2006.01)

(52) U.S. Cl.
CPC ..... *D03D 19/00* (2013.01); *D10B 2501/043* (2013.01)

(58) Field of Classification Search
CPC ..... D10B 2501/043; D10B 2403/032; A43B 3/0078; A43B 1/05; D03C 9/02
See application file for complete search history.

(56) References Cited

U.S. PATENT DOCUMENTS

| | | | | |
|---|---|---|---|---|
| 7,759,266 | B2 * | 7/2010 | Hawkins | B65G 15/34 442/205 |
| 9,283,699 | B2 * | 3/2016 | Morrow | B29C 45/14065 |
| 11,013,595 | B2 * | 5/2021 | Levi | A61F 2/2415 |
| 11,952,684 | B2 * | 4/2024 | Song | A43B 23/24 |
| 2014/0206248 | A1 * | 7/2014 | Vito | B32B 25/12 442/268 |
| 2014/0338222 | A1 * | 11/2014 | Song | D03D 9/00 12/146 C |
| 2021/0307449 | A1 * | 10/2021 | Song | D03D 15/547 |

FOREIGN PATENT DOCUMENTS

| | | | |
|---|---|---|---|
| KR | 10-1557130 | B1 | 10/2015 |
| KR | 10-2045709 | B1 | 11/2019 |
| KR | 10-2240621 | B1 | 4/2021 |

* cited by examiner

<FRONT SURFACE> <REAR SURFACE>

MULTIPLE WOVEN LENO-JACQUARD FABRIC AND SHOE UPPER MANUFACTURED THEREFROM

CROSS-REFERENCE TO RELATED APPLICATIONS

This application is a national phase application of PCT Application No. PCT/KR2022/016214, filed on 24 Oct. 2022, which claims benefit of Korean Patent Application No. 10-2021-0194742, filed on 31 Dec. 2021. The entire disclosures of the applications identified in this paragraph are incorporated herein by references.

BACKGROUND

Field

The present disclosure relates to a multiple woven leno-jacquard fabric and a shoe upper manufactured therefrom.

Related Art

Shoes include a sole which is a part that touches a ground, and a shoe upper which is combined with the sole and surrounds a foot of a wearer.

In order to improve the manufacturing convenience and manufacturing efficiency of such shoes, the shoe upper may be woven as an integral piece. Details regarding the shoe upper as integrally woven are described in Korea Patent No. 10-1437472 (Aug. 28, 2014). In addition, a heterogeneous weave fabric weaving loom and a shoe upper and shoe woven using the loom are described in Korea Patent No. 10-1557130 (Sep. 24, 2015) in detail.

However, in order to insert a pattern such as a logo into the shoe upper, separate sewing work is required to sew and attach a separately manufactured pattern member to the shoe upper. In particular, in order to insert various patterns into the shoe upper using a multi-color warp, a process of producing the pattern and a process of sewing and attaching the produced pattern to the shoe upper are required, which is very complicated and increases the manufacturing cost.

PATENT LITERATURE (Patent Literature 1) Korea Patent No. 10-1437472 (Aug. 28, 2014)

(Patent Literature 2) Korea Patent No. 10-1557130 (Sep. 24, 2015)

SUMMARY

An object of the present disclosure is to provide a multiple woven leno-jacquard fabric including a pattern weave having multiple layers and a shoe upper manufactured therefrom.

Another object of the present disclosure is to provide a multiple woven leno-jacquard fabric including a layer that provides a three-dimensional pattern effect and a shoe upper manufactured therefrom.

According to an aspect of the present disclosure, there is provided a multiple woven fabric including a ground weave and a pattern weave, in which the ground weave and the pattern weave are arranged to be neighboring, the ground weave includes a plain weave woven so that a warp and a weft participate in weaving, the pattern weave is a multi-layer weave including a first weave forming a first layer and a second weave separated from the first layer to form a second layer, the warp and the weft participate in the weaving of the ground weave and the pattern weave, the first weave is leno weave in which a pair of two warps including a first warp and a second warp is twisted while crossing each other centered on the weft to form an opening and which is woven so that the weft penetrates the opening, and the weaving is performed so that the first warp always passes through a lower portion of the weft and the second warp always passes through an upper portion of the weft on a side surface of the first weave.

A multiple woven fabric according to one aspect of the present disclosure and a shoe upper manufactured therefrom include a pattern weave including multiple layers, and thus, various patterns can be expressed without a separate sewing process.

A multiple woven fabric and a shoe upper according to another aspect of the present disclosure include a layer that provides a three-dimensional pattern effect, and thus, it is possible to efficiently display a three-dimensional pattern effect in a single process without a separate three-dimensional pattern manufacturing process and attachment process.

DESCRIPTION OF EXEMPLARY EMBODIMENTS

Hereinafter, embodiments of the present disclosure will be described in detail with reference to the attached drawings.

In the present specification, a fabric is largely divided into a plain weave and a twisted weave.

In the present specification, the plain weave refers to a fabric made up of a warp and a weft woven side by side, and for example, a three-way weave represented by a flat weave, a twill weave, and a satin weave corresponds to this.

In the present specification, the twisted weave refers to a fabric in which the wefts are formed side by side, but the warps are twisted by switching positions at regular intervals. For example, a leno weave in which a pair of two warps is twisted while crossing each other centered on the weft to form an opening and which is woven so that the weft penetrates the opening corresponds to the twisted weave. In the case of the leno weave in the present specification, in the pair of two warps, a first warp always passes through a lower portion of the weft, and a second warp always passes through the upper portion of the weft.

Meanwhile, generally, a warp is inserted into a healed eye positioned at the center of a heald so that the warp can pass through, the warp passes through the healed eye, then, the warp is raised and lowered by a vertical movement of the heald to form an opening between neighboring warps, the weft is inserted into the opening, and thus, a fabric is woven. According to a type of an opening device, the fabric can be divided into a dobby fabric in which a simple weave or a small pattern can be woven, and a jacquard fabric in which a large or complex pattern can be woven.

The dobby fabric is woven using a dobby device when a relatively small pattern is to be displayed on the fabric. Depending on the pattern, for example, 20 to 40 healds are fixed to a heald frame and move up and down together, the heald movement is controlled to form the opening between the warps, the weft is inserted into the formed opening, and thus, the dobby fabric is woven.

In the jacquard fabric, each warp is controlled by an independent heald, the heald is not fixed to the heald frame, but each heald moves up and down independently, the heald movement is controlled to form an opening between the warps, the weft is inserted into the formed opening, and the fabric is woven. The jacquard fabric is woven by a jacquard loom.

In the present disclosure, a fabric including a plain weave and a twisted weave can be woven in one process by a heterogeneous weave fabric weaving loom including a jacquard heald and a leno heald.

Figure 12:
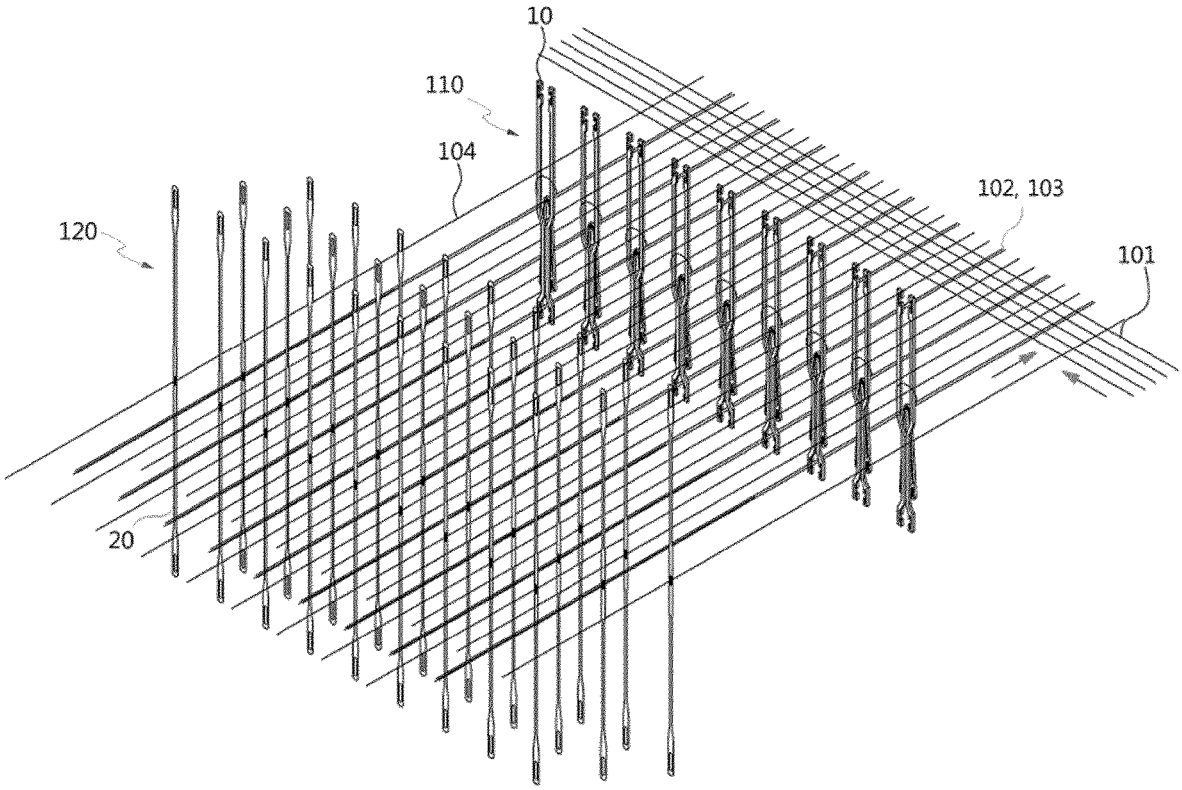
FIG. 12 illustrates FIG. 1 of Korea Patent No. 10-1557130 (Sep. 24, 2015) which is the related art.

Referring to FIG. 12, for example, in the present disclosure, the twisted weave is woven when a leno heald 10 is operated in a heterogeneous weave fabric weaving loom, and the plain weave which is a non-twisted weave can be woven when the leno heald 10 is not operated and only a jacquard heald 20 is operated. Here, not only the jacquard heald 20 but also the leno heald 10 can control the heald movement by moving up and down independently without being fixed to the heald frame.

In this way, the fabric woven in one process by the heterogeneous weave fabric weaving loom including the jacquard heald and leno heald is called leno-jacquard fabric in the present disclosure. Therefore, the leno-jacquard fabric according to the present disclosure may include a heterogeneous weave having the plain weave and the leno weave, only the plain weave, or only the leno weave.

Figure 1:
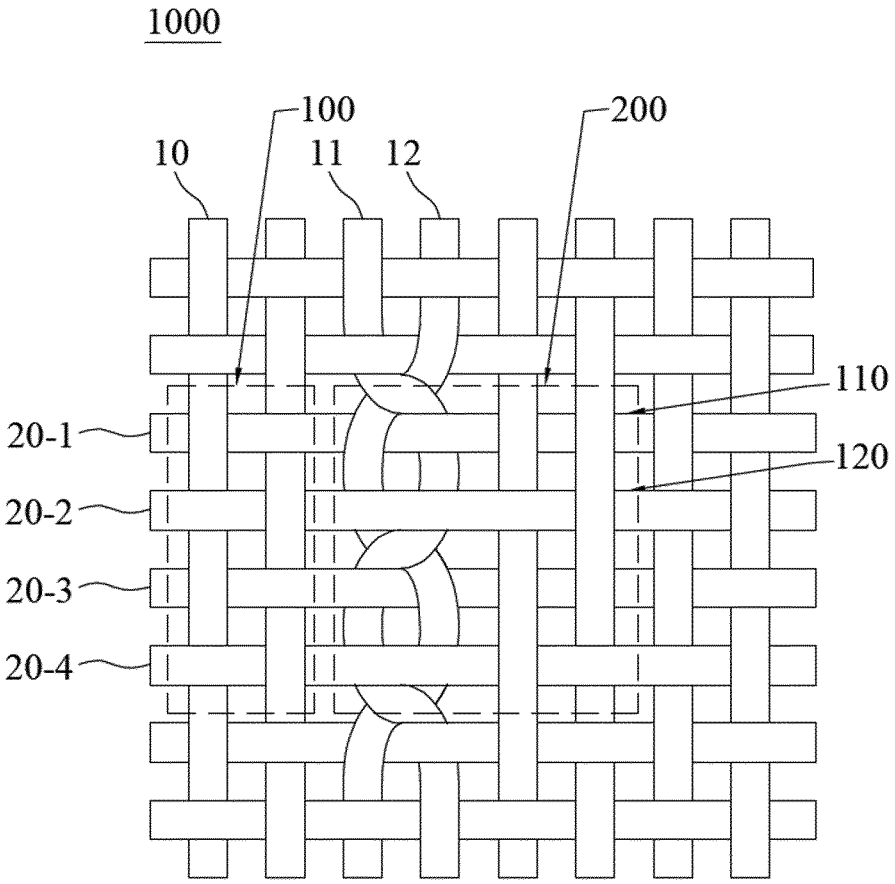
FIG. 1 is a diagram schematically illustrating a multiple woven fabric according to one embodiment of the present disclosure.

FIG. 1 is a diagram schematically illustrating a multiple woven fabric according to one embodiment of the present disclosure.

Referring to FIG. 1, a multiple woven fabric 1000 according to one embodiment of the present disclosure includes a ground weave 100 and a pattern weave 200.

The ground weave 100 and the pattern weave 200 may be arranged to be neighboring to each other. Referring to FIG. 1, the pattern weave 200 is illustrated at the center of FIG. 1 and the ground weave 100 is illustrated to the left side of the pattern weave 200. However, the ground weave 100 may be disposed up, down, left, and right centered on the pattern weave 200, and the pattern weave 200 may be disposed to be neighboring to the ground weave 100.

FIG. 9 is a diagram illustrating a photograph of the multiple woven fabric woven in this way.

The ground weave 100 includes a plain weave woven so that a warp 10 and a weft 20 participate in weaving. In FIG. 1, the plain weave is illustrated as a flat weave, but it is not limited thereto and may, for example, be a twill weave or a satin weave.

The pattern weave 200 is a multi-layer weave that includes a first weave 110 that forms a first layer, and a second weave 120 that is separated from the first layer and forms a second layer.

The warp 10 and the weft 20 may participate in the weaving of the ground weave 100 and the pattern weave 200. Since the ground weave 100 and the pattern weave 200 are arranged to be neighboring to each other, when explained based on horizontal rows of the ground weave 100 and the pattern weave 200, the weft 20 participates in the weaving of the ground weave 100, and the pattern weave 200 participates in the weaving of the pattern weave 200. Meanwhile, when explained based on vertical rows of the ground weave 100 and the pattern weave 200, a warp 11 or 12 participates in the weaving of the pattern weave 200 and participates in the weaving of the ground weave disposed on the upper and lower sides of the pattern weave 200.

The first weave 110 which forms the first layer of the pattern weave 200 is a leno weave in which a pair of two warps including the first warp 11 and the second warp 12 is twisted while crossing each other centered on the weft 20 to form an opening and which is woven so that the weft 20 penetrates the opening. On a side surface, the first warp 11 always passes through the lower portion of the weft 20, and the second warp 12 always passes through the upper portion of the weft 20.

Meanwhile, although the second weave 120 in FIG. 1 is presented as a plain weave, this is only an example, and the second weave may be a twisted weave such as the leno weave, which will be described later, as well as the plain weave.

Describing the weaving method of the pattern weave 200, which is a double-layer weave illustrated in FIG. 1, the weft penetrating a first opening formed by the first warp 11 and the second warp 12 in the first weave 110 of the leno weave is a first weft 20-1, and the weft penetrating a second opening adjacent to the first opening is a third weft 20-3 disposed next to a second weft 20-2 adjacent to the first weft 20-1.

Meanwhile, the wefts that participate in the weaving together with warp in the second weave 120 presented as the plain weave are the second weft 20-2 and a fourth weft 20-4 that do not participate in the weaving of the first weave 110.

Therefore, for the first weft 20-1, second weft 20-2, third weft 20-3, and fourth weft 20-4 arranged sequentially, the wefts participating in the weaving of the first weave 110 are the first weft 20-1 and the third weft 20-3, and the wefts participating in the weaving of the second weave 120 are the second weft 20-2 and the fourth weft 20-4. In the case of the pattern weave 200 illustrated in FIGS. 2 to 11 below, the first weave, the second weave, and the third weave can be woven similarly by appropriately selecting the wefts participating in each weaving.

In a multiple woven fabric 1000 according to another embodiment of the present disclosure, the wefts 20 participating in the weaving of the ground weave 100 are arranged to be neighboring to each other and woven to form a single-layer weave. Referring to FIG. 1, wefts 20 may be arranged to be neighboring to each other on a plane and not overlap each other. Therefore, the ground weave 100 in which the weft 20 is woven by the warp 10 forms a single-layer weave.

Figure 2:
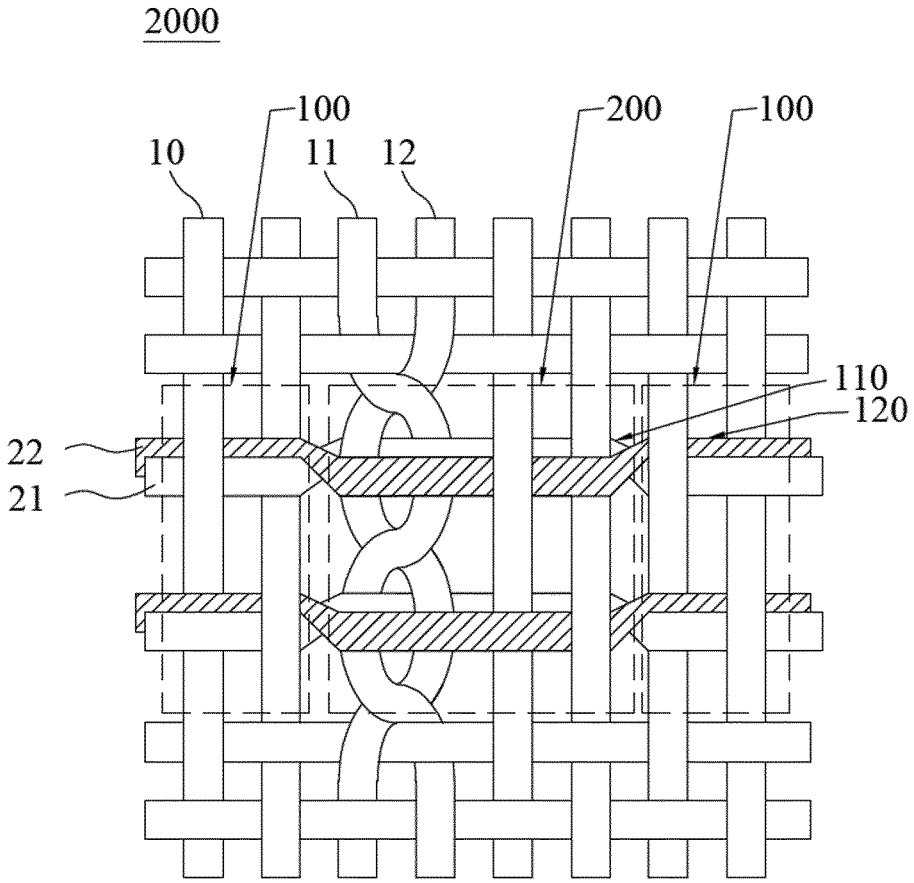
FIG. 2 is a diagram schematically illustrating a multiple woven fabric according to another embodiment of the present disclosure.

FIG. 2 is a diagram schematically illustrating a multiple woven fabric according to another embodiment of the present disclosure.

Referring to FIG. 2, in a multiple woven fabric 2000 according to another embodiment of the present disclosure, the weft includes the first weft 21 participating in the weaving of the first weave 110, and the second weft 22 participating in the weaving of the second weave 120, and the first weft 21 and second weft 22 participating in the weaving of the ground weave 100 are arranged and woven to overlap each other on a plane to form a double-layer weave.

Specifically, the weft includes the first weft 21 and the second weft 22, and the first weft 21 and the second weft 22 participate in weaving the ground weave 100 and the pattern weave 200. Here, the first weft 21 participates in the weaving the first weave 110 of the pattern weave 200, and the second weft 22 participates in the weaving the second weave 120 of the pattern weave 200. When the first weft 21 and the second weft 22 participate in the weaving of the ground weave 100, the first weft 21 and the second weft 22 are arranged and woven to overlap each other on a plane, and thus, the ground weave 100 is formed as a double-layer weave.

FIG. 2 schematically illustrates that, on a plane, the first weft 21 is disposed in front of the second weft 22, the second weft 22 is disposed in the rear of the first weft 21, and the first weft 21 and the second weft 22 of the ground weave 100 overlap each other.

In a multiple woven fabric 2000 according to another embodiment of the present disclosure, the first weft 21 and the second weft 22 participating in the weaving of the ground weave 100 participate in the weaving together by the warp 10, and thus, the weaving is performed so that layer separation does not occur.

Referring to FIG. 2, in the ground weave 100, the first weft 21 and the second weft 22 overlap each other and are woven together by the warp 10 and another neighboring warp, and thus, the weaving is performed so that the layer separation between the first weft 21 and the second weft 22 overlapping each other does not occur.

Meanwhile, when the first weft 21 and the second weft 22 are woven separately by warp, the weaving may be performed so that the weave woven by the first weft 21 and the warp and the weave woven by the second weft 22 and another warp are layer-separated from each other.

In the multiple woven fabric 2000 according to another embodiment of the present disclosure, the weaving is performed so that the first weft 21 is disposed in the front of the second weft 22 in the ground weave 100 and disposed in the rear of the second weft 22 in the pattern weave 200 on a plane.

Referring to FIG. 2, in the ground weave 100, the first weft 21 is disposed in front of the second weft 22 and the second weft 22 is disposed in the rear of the first weft 21, and in the pattern weave 200, the front-to-back arrangement of the first weft 21 and the second weft 22 is reversed so that the first weft 21 is disposed in the rear of the second weft 22 and the first weft 21 and the second weft 22 overlap each other.

Figure 3:
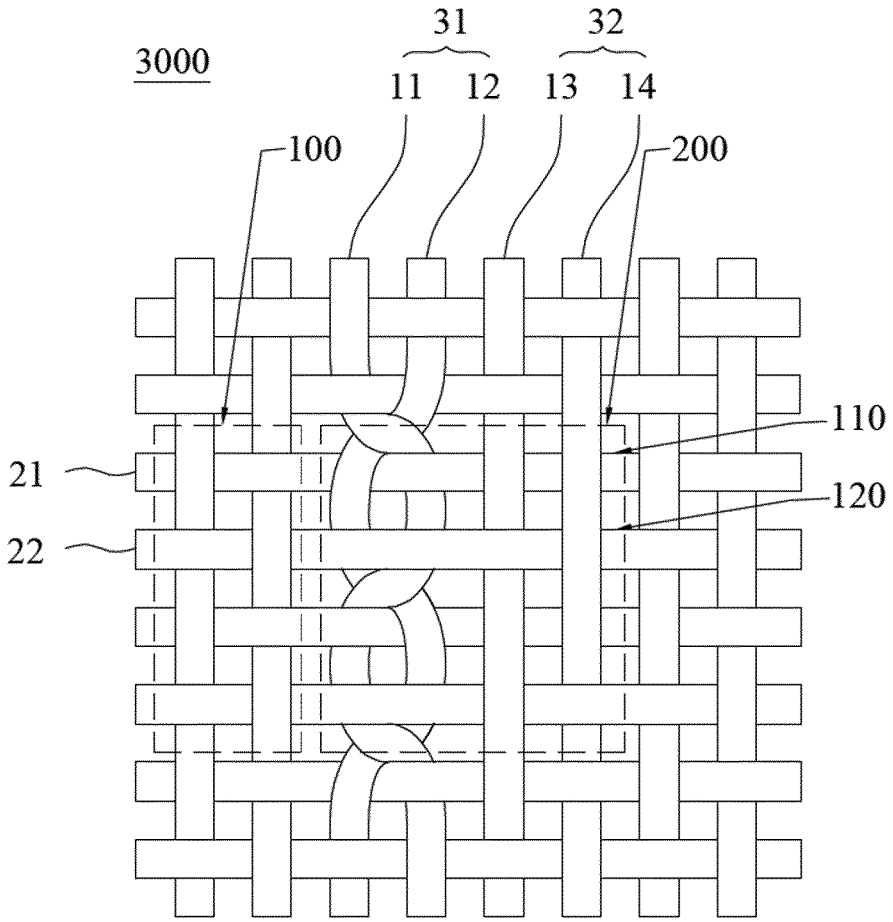
FIG. 3 is a diagram schematically illustrating a multiple woven fabric according to another embodiment of the present disclosure.

FIG. 3 is a diagram schematically illustrating a multiple woven fabric according to another embodiment of the present disclosure.

Referring to FIG. 3, in a multiple woven fabric 3000 according to another embodiment of the present disclosure, the warp includes a first warp pair 31 having a pair of warps and a second warp pair 32 having a pair of warps, and the weft includes the first weft 21 and the second weft 22.

Accordingly, in the pattern weave 200, the first weave 110 is configured by weaving the first warp pair 31 and the first weft 21, and the second weave 120 is configured by weaving the second warp pair 32 and the second weft 22.

Meanwhile, similar to the above-mentioned, the second weave 120 in FIG. 3 is presented as a plain weave, but this is only an example, and the second weave 120 may be the twisted weave such as the leno weave, which will be described later, as well as the plain weave.

FIG. 4 is a diagram schematically illustrating a multiple woven fabric according to another embodiment of the present disclosure.

Figure 4A:
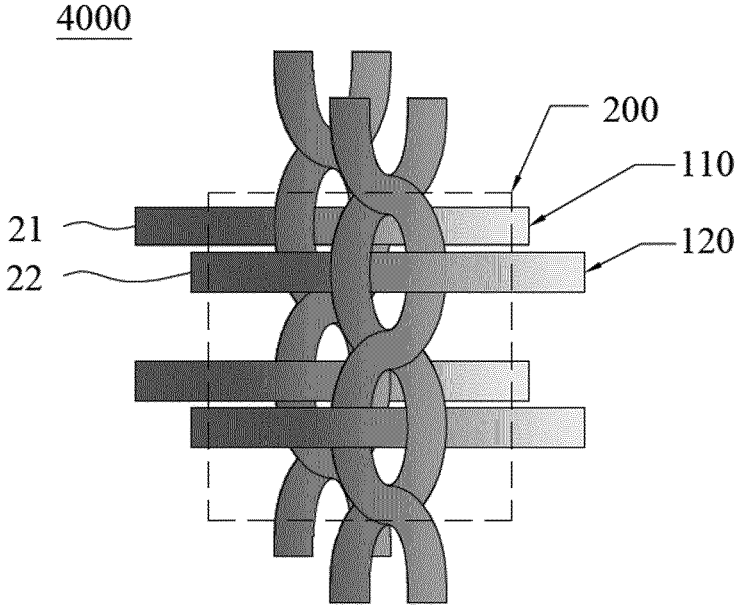
FIGS. 4*a* and 4*b* are a diagram schematically illustrating a multiple woven fabric according to another embodiment of the present disclosure.
Figure 4B:
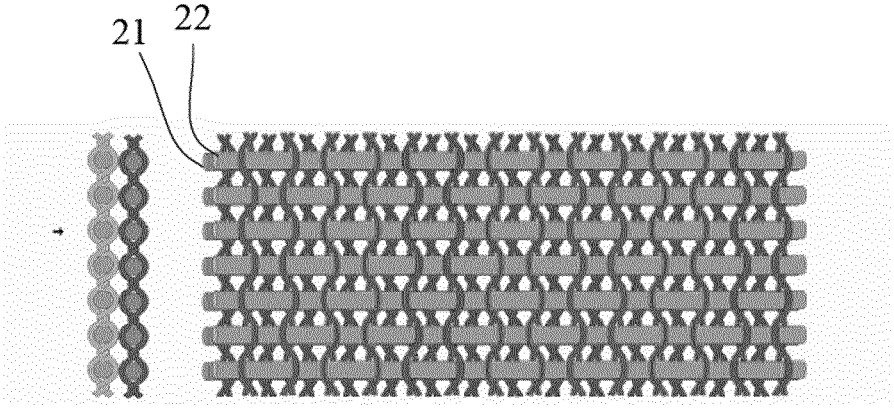

Referring to FIG. 4, in a multiple woven fabric 4000 according to another embodiment of the present disclosure, the second weave 120 is a leno weave. FIG. 4 illustrates only the portion of the pattern weave 200 of the multiple woven fabric 4000. FIG. 4*a* is a diagram schematically illustrating the pattern weave 200, and FIG. 4*b* is a diagram illustrating the pattern weave 200 in more detail.

FIGS. 5 to 8 below also illustrate only the portion of the pattern weave 200 of the multiple woven fabric.

Referring to FIG. 4, both the first weave 110 and the second weave 120 are woven with leno weave.

Figure 9A:
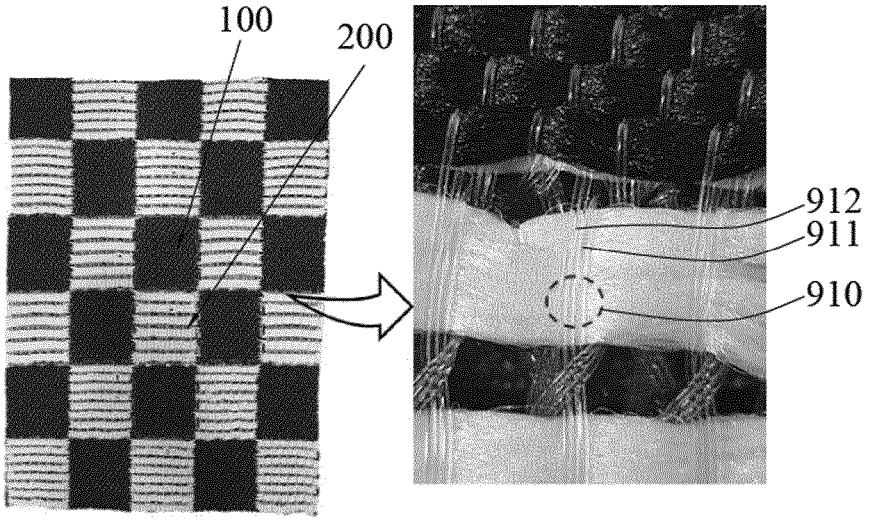
FIGS. 9*a* and 9*b* are a diagram illustrating a photograph of a multiple woven fabric according to another embodiment of the present disclosure.
Figure 9B:
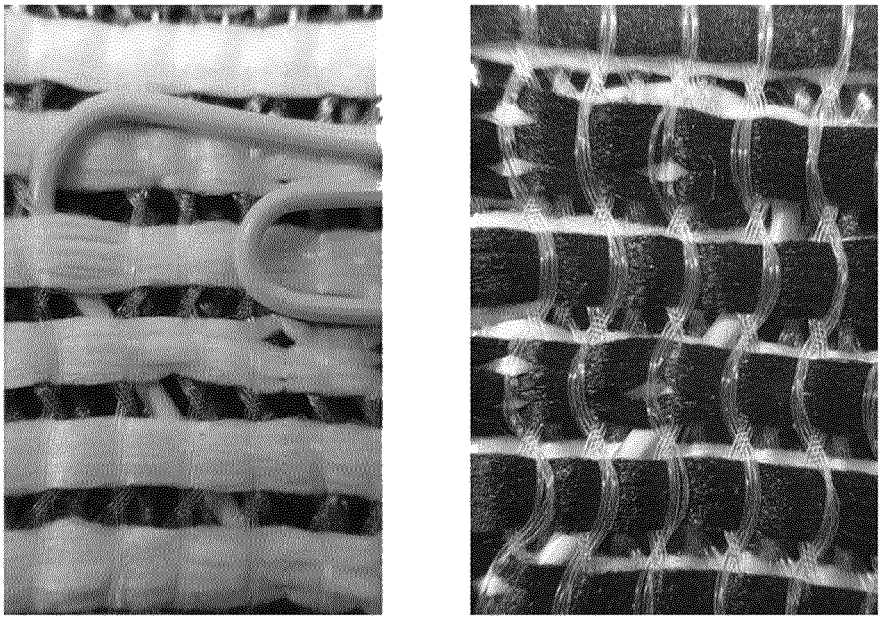

Meanwhile, FIG. 9*b* presents an enlarged photograph of a fabric according to the present disclosure in which the second weave 120 is configured of the leno weave.

The first weft 21 and the second weft 22 participating in the weaving of the pattern weave 200 are arranged to overlap each other on a plane and are woven to form a multi-layer weave. FIG. 4 schematically illustrates that the first weft 21 is disposed in the rear of the second weft 22 and the first weft and the second weft are woven to overlap each other on a plane. Here, the first warp pair and the second warp pair do not overlap each other due to characteristics of warps supplied in order and may be disposed to be neighboring to each other.

Meanwhile, referring to FIGS. 1 to 3, in the multiple woven fabric according to another embodiment of the present disclosure, in the pattern weave 200, elasticities of the warps 11 and 12 and the weft 21 participating in the weaving of the first weave 110 and elasticities of the warps 13 and 14 and the weft 22 participating in the weaving of the second weave 120 are different from each other.

For example, in a case of weaving the first weave with the plain weave and the second weave with the leno weave, when the warp or weft participating in the weaving of the first weave is used with a highly elastic rubber thread (for example, spandex) and the warp or weft participating in the weaving of the second weave is used with a general thread without elasticity, the second weave without elasticity may provide a three-dimensional pattern effect.

Figure 5:
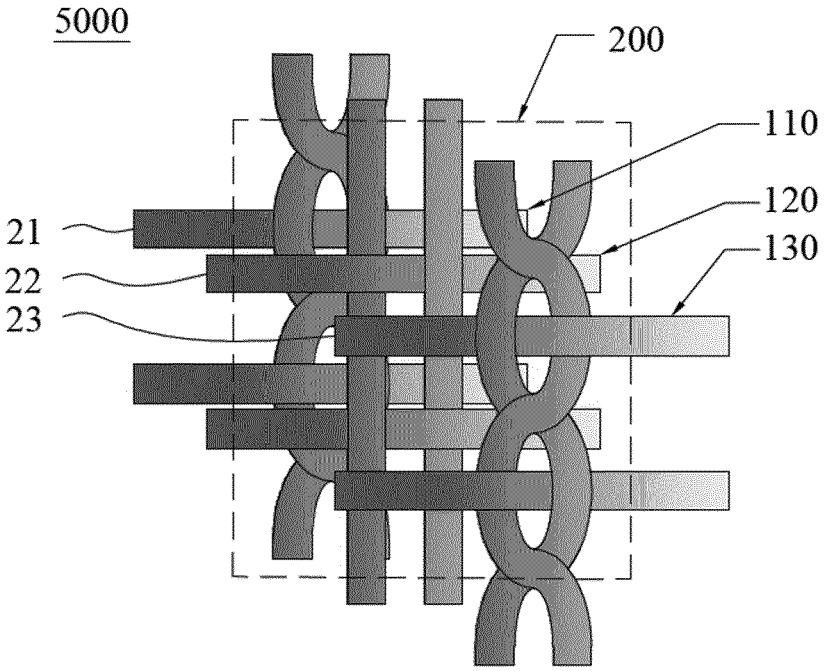
FIG. 5 is a diagram schematically illustrating a multiple woven fabric according to another embodiment of the present disclosure.

FIG. 5 is a diagram schematically illustrating a multiple woven fabric according to another embodiment of the present disclosure.

Referring to FIG. 5, in a multiple woven fabric 5000 according to another embodiment of the present disclosure, the pattern weave 200 further includes a third weave 130 that is separated from the second layer and forms a third layer.

FIG. 5 illustrates only the portion of the pattern weave 200 portion of the multiple woven fabric 5000. The pattern weave 200 of the multiple woven fabric 5000 illustrated in FIG. 5 includes the first weave 110 forming the first layer, the second weave 120 separating from the first layer and forming the second layer, and the third weave 130 separating from the second layer and forming the third layer.

Specifically, the weft includes the first weft 21 participating in the weaving of the first weave 110, the second weft 22 participating in the weaving of the second weave 120, and the third weft 23 participating in the weaving of the third weave 130. Here, the first weft 21 is woven with the warp to form the first weave 110, and separately, the second weft (22) is woven with another warp to form the second weave 120. Separately, the third weft 23 is woven with the other warp to form the third weave 130. The first weave 110, second weave 120, and third weave 130 woven in this way are separated from each other and layered to form a multi-layer weave.

Figure 10:
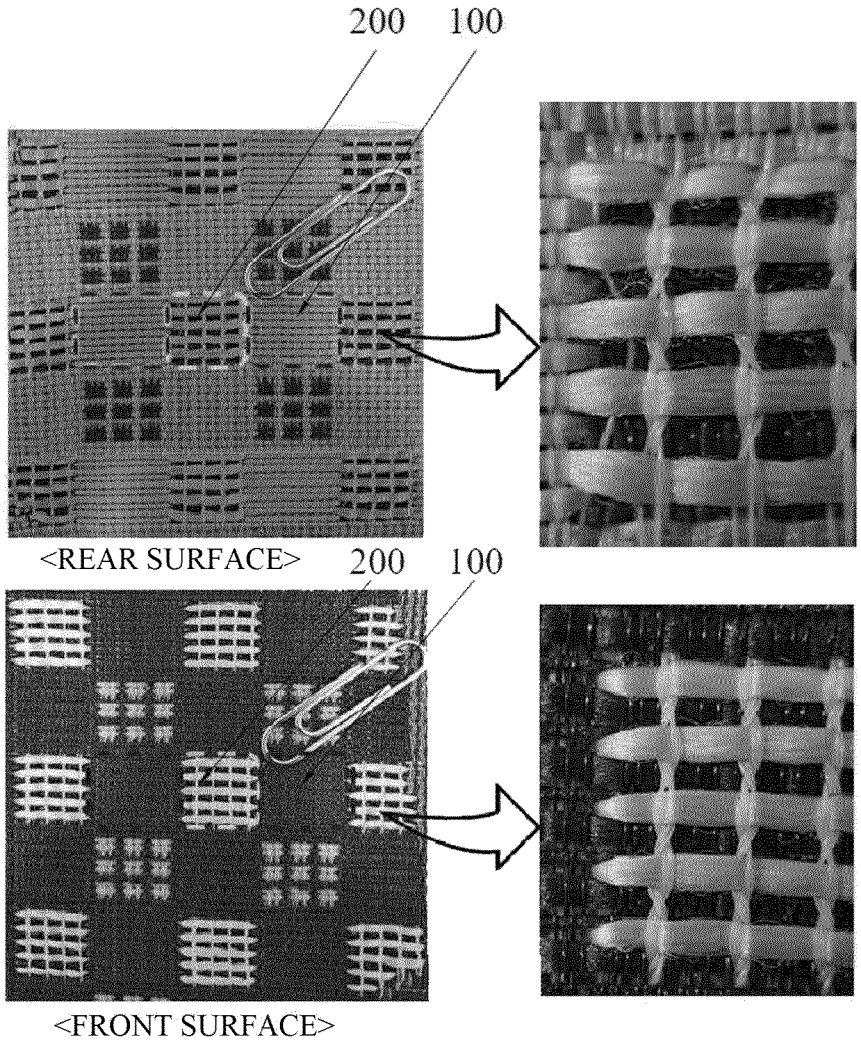
FIG. 10 is a diagram illustrating a photograph of a multiple woven fabric according to another embodiment of the present disclosure.

FIG. 10 is a diagram illustrating a photograph of the multiple woven fabric woven in this way. The photograph presented on the right side of FIG. 10 is an enlarged photograph of the pattern weave 200.

Referring to the rear surface of FIG. 10, the first weave woven with leno weave in the pattern weave 200 and the second weave woven in the rear of the first weave are illustrated. Moreover, referring to the front surface of FIG. 10, the third weave woven on the front of the second weave is illustrated.

In the multiple woven fabric according to another embodiment of the present disclosure, the weft includes the first weft 21 participating in the weaving of the first weave 110, the second weft 22 participating in the weaving of the second weave 120, and the third weft 23 participating in the weaving of the third weave 130. Moreover, in the first weft 21, the second weft 22, and the third weft 23 participating in the weaving of the ground weave, the first weft 21 and the second weft 22 are arranged to overlap each other on a plane and woven, the third weft 23 and another first weft 21' are arranged to overlap each other and woven. And thus, the double-layer weave is formed.

FIG. 5 illustrates only the pattern weave of the multiple woven fabric, and a ground weave is formed in an area adjacent to the pattern weave. Therefore, in the ground weave, the first weft 21 and the second weft 22 are arranged to overlap each other and woven, the third weft 23 and another first weft 21' are arranged to overlap each other, and thus, the ground weave can be formed into a double layer. FIG. 10 presents a photograph of the multiple woven fabric including a pattern weave (200) including the first weave, the second weave, and the third weave, and the ground weave 100 formed as a double layer.

Referring to FIG. 5, in the multiple woven fabric 5000 according to another embodiment of the present disclosure, the first weave 110 is the leno weave, the second weave (120) is the plain weave, and the third weave 130 is the leno weave.

Figure 6:
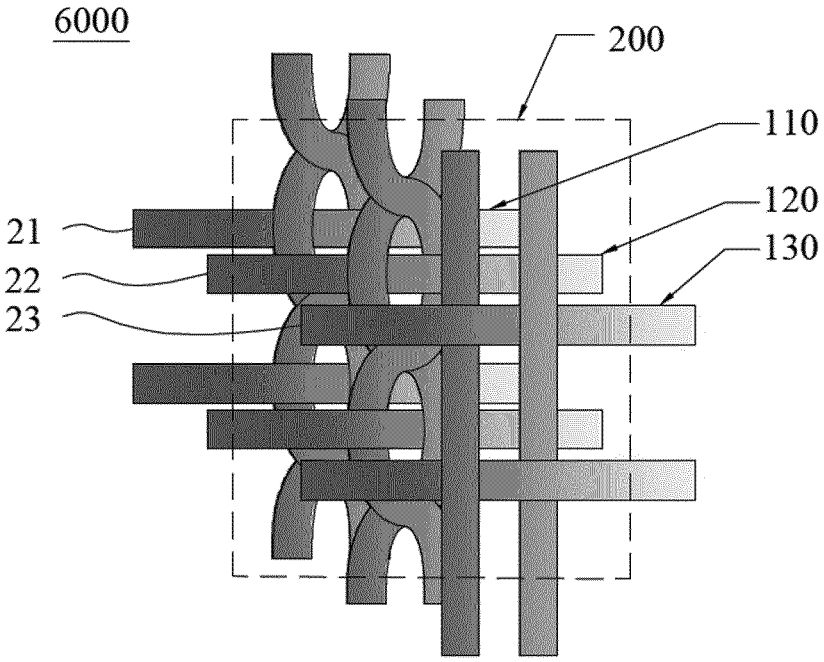
FIG. 6 is a diagram schematically illustrating a multiple woven fabric according to another embodiment of the present disclosure.

FIG. 6 is a diagram schematically illustrating a multiple woven fabric according to another embodiment of the present disclosure.

Referring to FIG. 6, in a multiple woven fabric 6000 according to another embodiment of the present disclosure, the first weave 110 is the leno weave, the second weave 120 is the leno weave, and the third weave 130 is the plain weave.

Figure 7:
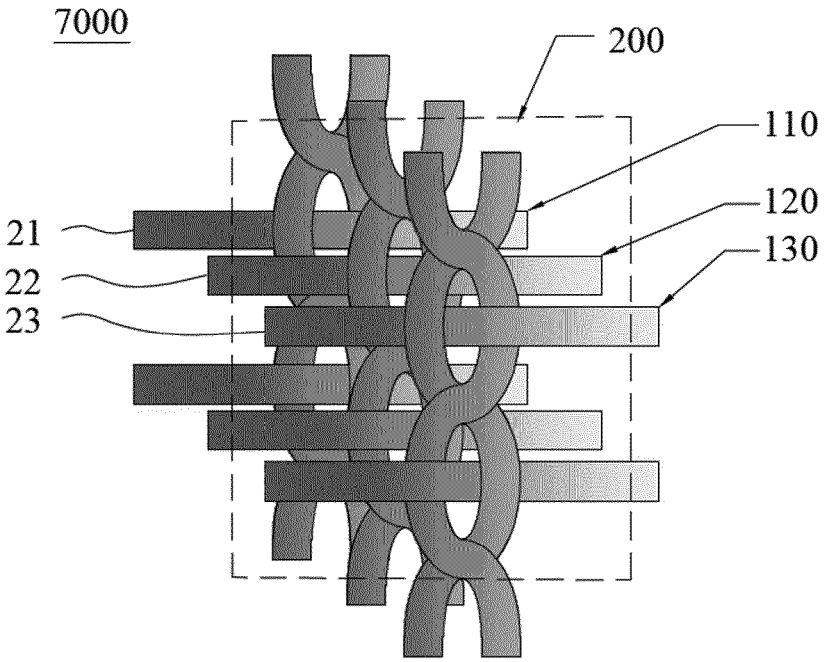
FIG. 7 is a diagram schematically illustrating a multiple woven fabric according to another embodiment of the present disclosure.

FIG. 7 is a diagram schematically illustrating a multiple woven fabric according to another embodiment of the present disclosure.

Referring to FIG. 7, in a multiple woven fabric 7000 according to another embodiment of the present disclosure, the first weave 110, the second weave 120, and the third weave 130 are all leno weaves.

Figure 8:
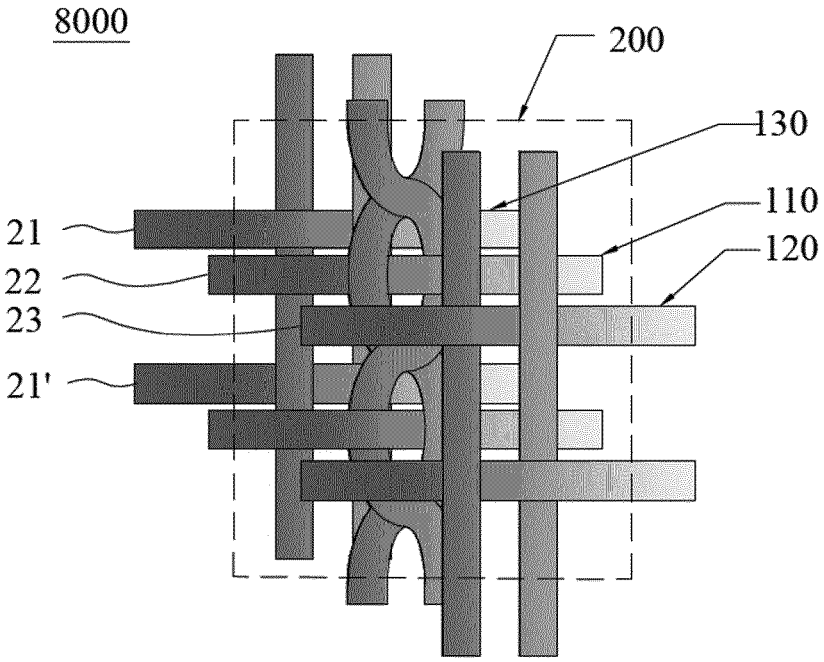
FIG. 8 is a diagram schematically illustrating a multiple woven fabric according to another embodiment of the present disclosure.

FIG. 8 is a diagram schematically illustrating a multiple woven fabric according to another embodiment of the present disclosure.

Referring to FIG. 8, in a multiple woven fabric 8000 according to another embodiment of the present disclosure, the pattern weave 200 is separated from the first layer to a side opposed to the second layer and includes the third weave 130 forming the third layer. Therefore, as illustrated in FIG. 8, in the multiple woven fabric 8000, the pattern weave 200 includes the third weave 130, the first weave 110, and the second weave 120 from the rear surface.

Here, the second weave 120 and the third weave 130 are plain weaves.

In a multiple woven fabric according to another embodiment of the present disclosure, the ground weave 100 and the pattern weave 200 are woven in one process by a heterogeneous weave fabric weaving loom.

Korea Patent No. 10-1557130 presented herein as the document of the related art discloses a "heterogeneous weave fabric weaving loom, and a shoe upper and a shoe woven using the same". According to this, in a multiple woven fabric according to the present disclosure, the ground weave and pattern weave may be woven in one process by the heterogeneous weave fabric weaving loom. Therefore, in the pattern weave, the first weave, second weave, and third weave may also be woven in one process by the heterogeneous weave fabric weaving loom.

To be described more specifically with reference to Korean Patent No. 10-1557130, the heterogeneous weave fabric weaving loom starts from the position where the weft is supplied and may include a leno heald disposed in a first row and a jacquard heald disposed in a second row located behind the first row. The warp may include a first warp that passes through a leno warp hole formed in a third needle of the leno heald, and a second warp that passes through a space between the third needle and the first needle or a space between the third needle and the second needle outside the leno warp hole. The first and second warps passing through the leno heald may be configured to pass through the jacquard warp holes of the first and second jacquard healds arranged in the second row, respectively. Therefore, the plain weave without twist may be woven when the jacquard heald arranged in the second row operates without the operation of the leno heald arranged in the first row, and the twisted weave may be woven when the leno heald arranged in the first row operates. In this way, the leno-jacquard fabric may be woven by the heterogeneous weave fabric weaving loom including the leno heald and the jacquard heald.

In another embodiment, each of the first warp, the second warp, and the weft may include a plurality of yarns. When each of the first warp and the second warp may include the plurality of yarns, the jacquard heald may be arranged to respectively correspond to the plurality of yarns. For example, when the first warp including a 1-1 warp and a 1-2 warp penetrates the leno warp hole, the 1-1 warp and the 1-2 warp pass through the same leno warp hole together, and then in jacquard heald, the first warp may be disposed to penetrate the jacquard warp hole of a 1-1 jacquard heald and a 1-2 jacquard heald which are separate jacquard healds. Similarly, for example, the second warp including a 2-1 warp and a 2-2 warp passes through the same space together when passing through a space between the needles in the leno heald, and then in jacquard heald, the first warp may be disposed to penetrate the jacquard warp hole of a 2-1 jacquard heald and a 2-2 jacquard heald which are separate jacquard healds. Therefore, in the twisted weave, for example, the first warp having two yarns and the second warp having two yarns may be woven with the weft, and then in the plain weave that is continuously woven, the warp including one yarn may be woven with the weft.

Referring to FIG. 9*a*, in the enlarged photograph illustrated on the right side of FIG. 9*a*, a first warp 910, a 1-1 warp 911, and a 1-2 warp 912 including a plurality of yarns are illustrated. The first warp 910 including the 1-1 warp 911 and the 1-2 warp 912 is woven with the weft in the twisted weave, but then in the plain weave, it can be seen that the 1-1 warp 911 and the 1-2 warp 912 are woven with the weft.

Meanwhile, the first warp having a plurality of yarns may be configured to penetrate a jacquard warp hole of the same jacquard heald together, and the second warp including a plurality of yarns may be configured to penetrate the jacquard warp hole of the same jacquard heald together. In this case, in the twisted weave, for example, the first warp having two yarns and the second warp having two yarns may be woven with the weft, and then, in the plain weave that is continuously woven, the warp having two yarns may also be woven with the weft.

Figure 11:
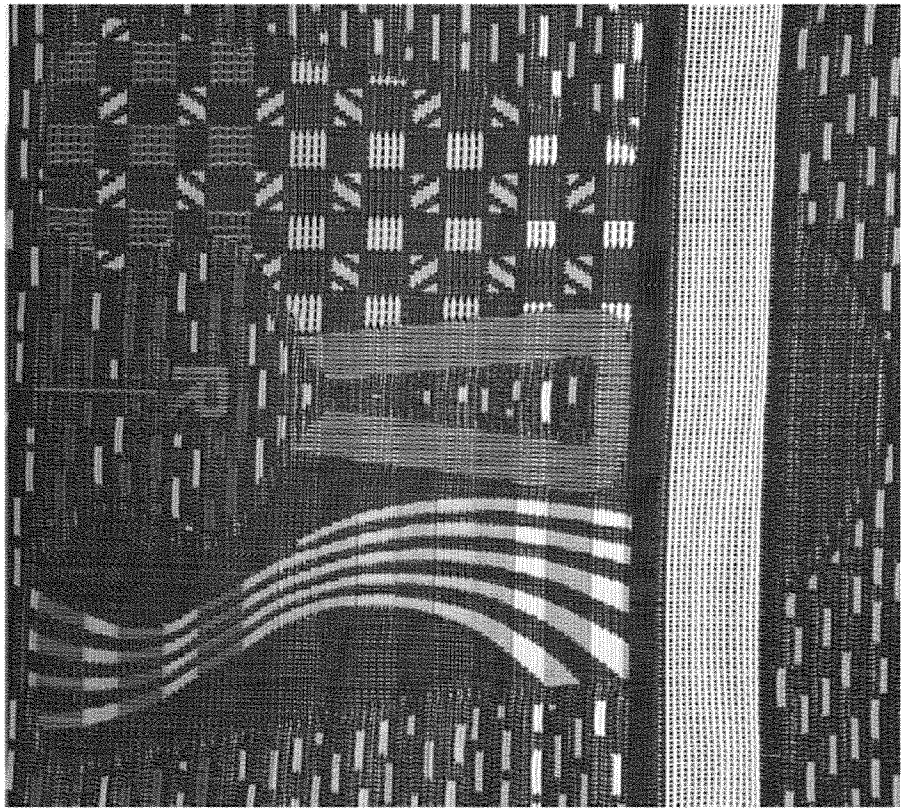
FIG. 11 is a diagram illustrating a photograph of a shoe upper made of multiple woven fabric according to another embodiment of the present disclosure.

FIG. 11 is a diagram illustrating a photograph of a shoe upper made of a multiple woven fabric according to one embodiment of the present disclosure.

Referring to FIG. 11, the shoe upper according to the present disclosure can be manufactured from the multiple woven fabric including the ground weave and various types of pattern weave. More specifically, the ground weave and pattern weave included in the multiple woven fabric according to the present disclosure may be woven in one process by the heterogeneous weave fabric weaving loom. That is, FIG. 11 is an actual photograph of the shoe upper made of the leno-jacquard fabric, which includes the ground weave and various types of pattern weaves according to the present disclosure and is woven by the heterogeneous weave fabric weaving loom, and the shoe upper can be woven in one process without requiring a separate sewing process.

According to another embodiment of the present disclosure, there may be provided a shoe made from the shoe upper manufactured from the multiple woven leno-jacquard fabric according to the present disclosure.

Thereafter, various embodiments of the present disclosure will be described.

(1) A multiple woven fabric comprising a ground weave and a pattern weave, wherein the ground weave and the pattern weave are arranged to be neighboring, the ground weave includes a plain weave woven so that a warp and a weft participate in weaving, the pattern weave is a multi-layer weave including a first weave forming a first layer and a second weave separated from the first layer to form a second layer, the warp and the weft participate in the weaving of the ground weave and the pattern weave, the first weave is a leno weave in which a pair of two warps including a first warp and a second warp is twisted while crossing each other centered on the weft to form an opening and which is woven so that the weft penetrates the opening, and the weaving is performed so that the first warp always passes through a lower portion of the weft and the second warp always passes through an upper portion of the weft on a side surface of the first weave.

(2) The weft participating in the weaving of the ground weave are arranged to be neighboring and woven to form single-layer weave.

(3) The weft includes a first weft participating in weaving of the first weave, and a second weft participating in weaving of the second weave, and the first weft and the second weft participating in the weaving of the ground weave are arranged to overlap each other on a plane and are woven to form a double-layer weave.

(4) The first weft and the second weft participating in the weaving of the ground weave participate in the weaving together by the warp and are woven to prevent layer separation.

(5) In a plan view, the first weft is woven to be disposed in front of the second weft in the ground weave and is woven to be disposed on the rear of the second weft in the pattern weave.

(6) The warp includes a first warp pair having a pair of warps and a second warp pair having a pair of warps, the weft includes a first weft and a second weft, the first weave is configured so that the first warp pair and the first weft are woven, and the second weave is configured so that the second warp pair and the second weft are woven.

(7) The second weave is a leno weave, and the first weft and the second weft participating in the weaving of the pattern weave 200 are arranged and woven overlapping each other on a plane.

(8) Elasticity of the warp and weft participating in the weaving of the first weave and elasticity of the warp and weft participating in the weaving of the second weave are different from each other.

(9) The ground weave and the pattern weave are woven in one process by a heterogeneous weave fabric weaving loom including a leno heald and a jacquard heald to form a leno-jacquard fabric.

(10) The pattern weave further includes the third weave which is separated from a second layer and forms a third layer.

(11) The weft includes a first weft participating in the weaving of the first weave, a second weft participating in the weaving of the second weave, and a third weft participating in the weaving of the third weave, and in the first weft, the second weft, and the third weft participating in the weaving of the ground weave, the first weft and the second weft are woven to be arranged to overlap each other and the third weft and another first weft are woven to be arranged to overlap each other on a plane to form a double-layer weave.

(12) The second weave is plain weave and the third weave is a leno weave.

(13) The second weave is a leno weave and the third weave is a plain weave.

(14) The second weave and the third weave are leno weaves.

(15) The multiple woven fabric of claim 1, wherein the pattern weave further includes a third weave which is separated from the first layer to an opposite side of the second layer to form the third weave, and the second weave and third weave are plain weaves.

(16) The ground weave and the pattern weave are woven in one process by a heterogeneous weave fabric weaving loom including a leno heald and a jacquard heald to form a leno-jacquard fabric.

(17) A shoe upper manufactured by the multiple woven fabric.

REFERENCE SIGN LIST

100: ground weave; 110: first weave; 120: second weave; 130: third weave; 200: pattern weave; 1000, 2000, 3000, 4000, 5000, 6000, 7000, 8000: multiple woven fabric

What is claimed is:

1. A multiple woven fabric comprising a ground weave and a pattern weave, wherein the ground weave and the pattern weave are arranged to be neighboring, the ground weave includes a plain weave woven so that a warp and a weft participate in weaving, the pattern weave is a multi-layer weave including a first weave forming a first layer and a second weave separated from the first layer to form a second layer, the warp and the weft participate in the weaving of the ground weave and the pattern weave, the first weave is a leno weave in which a pair of two warps including a first warp and a second warp is twisted while crossing each other centered on the weft to form an opening and which is woven so that the weft penetrates the opening, and the weaving is performed so that the first warp always passes through a lower portion of the weft and the second warp always passes through an upper portion of the weft on a side surface of the first weave.

2. The multiple woven fabric of claim 1, wherein the weft participating in the weaving of the ground weave are arranged to be neighboring and woven to form single-layer weave.

3. The multiple woven fabric of claim 1, wherein the weft includes a first weft participating in weaving of the first weave, and a second weft participating in weaving of the second weave, and the first weft and the second weft participating in the weaving of the ground weave are arranged to overlap each other on a plane and are woven to form a double-layer weave.

4. The multiple woven fabric of claim 3, wherein the first weft and the second weft participating in the weaving of the ground weave participate in the weaving together by the warp and are woven to prevent layer separation.

5. The multiple woven fabric of claim 3, wherein in a plan view, the first weft is woven to be disposed in front of the second weft in the ground weave and is woven to be disposed on the rear of the second weft in the pattern weave.

6. The multiple woven fabric of claim 1, wherein the warp includes a first warp pair having a pair of warps and a second warp pair having a pair of warps, the weft includes a first weft and a second weft, the first weave is configured so that the first warp pair and the first weft are woven, and the second weave is configured so that the second warp pair and the second weft are woven.

7. The multiple woven fabric of claim 6, wherein the second weave is a leno weave, and the first weft and the second weft participating in the weaving of the pattern weave 200 are arranged and woven overlapping each other on a plane.

8. The multiple woven fabric of claim 1, wherein elasticity of the warp and weft participating in the weaving of the first weave and elasticity of the warp and weft participating in the weaving of the second weave are different from each other.

9. The multiple woven fabric of claim 1, wherein the ground weave and the pattern weave are woven in one process by a heterogeneous weave fabric weaving loom including a leno heald and a jacquard heald to form a leno-jacquard fabric.

10. The multiple woven fabric of claim 1, wherein the pattern weave further includes the third weave which is separated from a second layer and forms a third layer.

11. The multiple woven fabric of claim 10, wherein the weft includes a first weft participating in the weaving of the first weave, a second weft participating in the weaving of the second weave, and a third weft participating in the weaving of the third weave, and in the first weft, the second weft, and the third weft participating in the weaving of the ground weave, the first weft and the second weft are woven to be arranged to overlap each other and the third weft and another first weft are woven to be arranged to overlap each other on a plane to form a double-layer weave.

12. The multiple woven fabric of claim 10, wherein the second weave is plain weave and the third weave is a leno weave.

13. The multiple woven fabric of claim 10, wherein the second weave is a leno weave and the third weave is a plain weave.

14. The multiple woven fabric of claim 10, wherein the second weave and the third weave are leno weaves.

15. The multiple woven fabric of claim 1, wherein the pattern weave further includes a third weave which is separated from the first layer to an opposite side of the second layer to form the third weave, and the second weave and third weave are plain weaves.

16. The multiple woven fabric of claim 10, wherein the ground weave and the pattern weave are woven in one process by a heterogeneous weave fabric weaving loom including a leno heald and a jacquard heald to form a leno-jacquard fabric.

17. A shoe upper manufactured by the multiple woven fabric according to claim 1.

* * * * *